US005957761A

United States Patent [19]

Miller et al.

[11] Patent Number: 5,957,761

[45] Date of Patent: Sep. 28, 1999

[54] CLOSED CIRCUIT MEDIA CAPTURE AND RECOVERY HEAD FOR THE PORTABLE WHEAT STARCH MEDIA BLAST SYSTEM

[75] Inventors: Raymond E. Miller, La Mirada; James J. Allard, Vacaville, both of Calif.; David B. Tracy, Lake Charles, La.; David J. Hancock, Chino Hills, Calif.; Brent R. Meredith, Fullerton, Calif.; Gregory N. Stein, Moreno Valley, Calif.

[73] Assignee: Northrop Grumman Corporation, Los Angeles, Calif.

[21] Appl. No.: 08/968,504

[22] Filed: Nov. 12, 1997

[51] Int. Cl.[6] ..... B24C 3/06

[52] U.S. Cl. ..... 451/92; 451/87; 451/89; 451/350; 451/354

[58] Field of Search ..... 451/92, 90, 102, 451/75, 38, 91, 350, 354, 87

[56] References Cited

U.S. PATENT DOCUMENTS

| | | | |
|---|---|---|---|
| 3,900,969 | 8/1975 | Diehn | 51/9 M |
| 3,906,673 | 9/1975 | Goto et al. | 51/9 M |
| 3,916,568 | 11/1975 | Rose et al. | 51/8 R |
| 4,132,039 | 1/1979 | Gilbert et al. | 51/424 |
| 4,149,345 | 4/1979 | Atsuchi | 51/424 |
| 4,785,588 | 11/1988 | Woodward | 51/429 |
| 4,984,396 | 1/1991 | Urakami | 51/424 |

*Primary Examiner*—David A. Scherbel
*Assistant Examiner*—Dung Van Nguyen
*Attorney, Agent, or Firm*—Terry J. Anderson; Karl J. Hoch, Jr.

[57] ABSTRACT

A blast head for abrasive blasting has a nozzle for directing a blast media at a surface being treated and a housing for containing the blast media after it passes through the nozzle and for facilitating recirculation of the blast media. An adjustment mechanism facilitates varying of the orientation of the nozzle with respect to the surface being treated, so as to facilitate enhanced blasting thereof.

21 Claims, 3 Drawing Sheets

CLOSED CIRCUIT MEDIA CAPTURE AND RECOVERY HEAD FOR THE PORTABLE WHEAT STARCH MEDIA BLAST SYSTEM

FIELD OF THE INVENTION

This invention relates generally to abrasive blasting systems, and more particularly to a closed circuit media blast head which provides control of angle of impingement and stand-off distance of blast media with respect to the surface to be treated, and containment and recapture of blast media.

BACKGROUND OF THE INVENTION

The three traditional ways of removing coatings from a composite material surface of an aircraft are sanding, scraping and chemical stripping. Sanding and scraping are manually done, very labor-intensive, and can cause surface gouges or abrasions. Chemical stripping using methylene chloride is the most efficient method, however, methylene chloride is a hazardous air pollutant and its use is scheduled to be eliminated by the year 1998 by the Clean Air Act. Sandblasting is another means of removing coatings from a surface. By impacting the coating with sand particles, sandblasting causes microfracture in the coating, allowing the coating to break free from the underlying surface. However, impacting off the coating with sand particles may cause some damage to the underlying composite material surface, such as scratches, pits, exposed fibers and even bond line damage. This makes sandblasting unacceptable for use on the types of aircraft which have most of the underlying surface made of composite material, or on a space shuttle orbiter which also has large areas of composite material.

It has been found that wheat starch, in the form of small crystallized particles, used in a blasting system, can effectively remove a coating from a composite material surface or an aluminum surface without damaging the surface. Due to the cutting characteristics of the sharp edges of the wheat starch particles, the coating is removed by being cut off the underlying surface instead of being impacted off the surface as in the case of sandblasting.

Currently, wheat starch media blasting is the only approved de-paint process for use on the types of aircraft which have the following coatings: polyurethane top coats, urethane primers and thick fluoro-elastomer rain-erosion coatings. The type of coating to be removed from certain portions of the surface of a space shuttle orbiter is silicone adhesive. Different types of coating require different angles of impingement and stand-off distances of blast media with respect to the surface to be treated. The more resilient the coating is, the lower the angle of impingement and the shorter the stand-off distance need to be. Thus, control of blast media angle of impingement and stand-off distance is a desired feature in a blasting system. Currently, this control is effected by a human operator in protective suit dispensing blast media from a nozzle attached to a blast hose. Since there is no containment and recapture of blast media, the de-paint process of an aircraft can only be done in a well-ventilated, environmentally controlled hangar, and not in an open environment. Presently, blasting systems called Vacuum Blasters, manufactured by VACU-BLAST Systems, Inc. and distributed by LTC Americas Inc. and others, provide containment and recapture of blast media, but provide practically no control of angle of impingement and stand-off distance. Thus, there is a need for a closed circuit media blasting system which provides control of blast media angle of impingement, stand-off distance, containment and recapture of blast media.

SUMMARY OF THE INVENTION

The present invention specifically addresses and alleviates the above mentioned deficiencies associated with the prior art. More particularly, the present invention comprises a blast head for abrasive blasting, the blast head comprising a nozzle for directing blast media at a surface being treated, a housing for containing blast media after it passes through the nozzle and for facilitating recirculation of the blast media, and an adjustment mechanism for varying orientation of the nozzle with respect to a surface being treated, so as to facilitate enhanced blasting thereof. As used herein, the term "orientation" includes both the angular attitude of the nozzle with respect to the surface being treated and the distance from the nozzle to the surface being treated, i.e., the standoff distance.

The adjustment mechanism preferably comprises a nozzle holder configured to slidably receive the nozzle so as to facilitate adjustment of a stand-off distance of the nozzle. The nozzle holder is preferably pivotally connected to the housing so as to facilitate adjustment of an angle at which blast media impact the surface being treated. Thus, according to the present invention, the adjustment mechanism comprises an attachment mechanism for facilitating attachment of the nozzle to the housing.

Thus, according to the preferred embodiment of the present invention, the blast media impact the surface being treated at a predetermined angle and at a predetermined distance from the nozzle, so as to optimize the blasting process. That is, the user can adjust the standoff distance and the angle at which blast media impact the surface being treated in a manner which provides the most effective blasting for the particular type of surface coating being removed from the surface.

Thus, the present invention comprises a blast head for abrasive blasting, wherein blast media impact a surface to be treated at a predetermined angle, the angle being regulatable for blasting different types of surface coatings, the blast head comprising a housing having a bottom side configured to be seated on the surface to be treated. The housing includes a blast chamber therein having a first opening for receiving blast media and a second opening placing the blast chamber in fluid communication with the surface to be treated.

A nozzle is in fluid communication with the blast chamber, for applying the blast media to the surface to be treated through the second opening of the blast chamber.

An adjustment mechanism pivotally connects the nozzle to the housing, thereby facilitating control of a pivotal movement of the nozzle with respect to the surface to be treated, so as to facilitate varying an angle at which blast media impacts the surface being treated.

Further, the blast head comprises a nozzle holder slidably receiving the nozzle so as to facilitate the adjustment of an axial translation of the nozzle with respect to the surface to be treated, so as to permit adjustment of the stand-off distance, as desired.

The blast head of the present invention preferably further comprises a sealing assembly for mitigating communication of blast media and particulate matter generated within the blast chamber during the blasting operation with the ambient environment within which the blast head is being utilized. The sealing assembly is preferably disposed about a periphery of the bottom side of the housing and is configured to contact the surface to be treated without causing damage to the surface contacted.

According to the preferred embodiment of the present invention, the sealing assembly is configured to allow a controlled intake of ambient air into the blast chamber so as to prevent the blast head from being drawn by suction force to the surface to be treated during the blasting operation.

It has been found that, when insufficient ambient air is permitted to be drawn into the blast chamber, the blast head is drawn to the surface being treated with sufficient force to undesirably inhibit lateral, i.e., forward, backward, or to either side, movement of the blast head. By facilitating a controlled intake of ambient air into the blast chamber, the suction force which tends to pull the blast head to the surface being treated is substantially reduced, thereby substantially reducing the amount of effort which is required to move the blast head laterally.

The sealing assembly preferably comprises a strip draping a substantial portion of a periphery of the second opening of the housing. The strip makes contact with the surface to be treated, so as to form a seal between the blast chamber and the ambient environment. The strip is preferably formed of an elastomeric material, such as rubber or a resilient plastic.

According to the preferred embodiment of the present invention, a flexible porous pad, such as a SCOTCH BRITE pad, is in contact with the periphery of the surface to be treated and forms a breathing weight-bearing surface for the blast head. The flexible porous pad also blocks the blast media and particulate matter generated in the blast chamber during the blasting operation from communicating with the ambient environment while allowing a controlled intake of ambient air into the blast chamber. The size of the interstices within the flexible porous pad determines the amount of air intake.

The flexible porous pad is preferably formed of a woven polymeric material.

Pivotal movement of the nozzle with respect to the surface to be treated is preferably regulatable from approximately 15 degrees to approximately 75 degrees. However, as those skilled in the art will appreciate, pivotal movement of the nozzle with respect to the surface may be regulatable over wider or narrower ranges, as desired. For example, pivotal movement of the nozzle with respect to the surface may be regulatable from 15 degrees to 90 degrees, as desired.

The housing preferably comprises a window configured to provide visibility of the second opening, i.e., the bottom opening of the housing, to facilitate observation of the blasting operation.

The nozzle tube preferably comprises a window for providing visibility of the nozzle to facilitate control of the axial translation of the nozzle with respect to the surface to be treated. Thus, the window of the nozzle tube allows the user to visually determine the standoff distance.

According to the preferred embodiment of the present invention, the blast chamber is configured to form a bifurcated air return. The bifurcated air return guides blast media and particulate matter generated during the blasting operation toward an exhaust passage. The bifurcated air return merges into the single exhaust passage, thus forming a plenum or manifold.

The nozzle can be of various type, such as standard round venturi, double venturi, or flat nozzle. Preferably, the nozzle is of a venturi type, having a plurality of transverse openings located proximate the output end of the nozzle and configured so as to draw air into an internal flow stream of the blast media, thereby increasing dispersion of the blast media in the pressurized fluid and decreasing the velocity of the pressurized blast media as the pressurized blast media enter the blast chamber.

A blast media source, preferably a tank or hopper, provides blast media via a blast hose which is in fluid communication with the nozzle of the blast head. According to the preferred embodiment of the present invention an actuator regulates dispensing of the blast media from the media source into the blast hose, thereby mitigating undesirable plugging of the blast hose with blast media.

A fluid source, preferably a dry filtered air source, is connected to the blast hose downstream from the actuator and provides a pressurized fluid flow into the blast hose. Pressurized fluid flow carries the dispensed blast media into the blast head. Examples of suitable fluids to be used in the invention are dry air or nitrogen which fluidize the blast media.

A vacuum source provides reduced pressure and is in communication with the exhaust passage of the blast chamber via a vacuum duct. The reduced pressure sucks out a mixture of the dispensed blast media and particulate matter generated during the blasting operation.

Wheat starch of mesh size of about 60 is preferably used as blast media in the present invention.

The blast head of the present invention further comprises a system of interlock valves which enables operation of the blast head only when it is seated against a plane surface. The blast head further comprises an override valve mechanism for bypassing the action of the system of interlock valves, thus permitting operation of the blast head on curved surfaces or when the blast head is not in contact with any surface.

Further, according to the methodology of the present invention, an angle at which blast media impact a surface to be treated is regulated to facilitate blasting of different types of surface coating. According to the present invention the method comprises the steps of seating a bottom side of a housing on the surface to be treated. The nozzle tube is placed in fluid communication with the first opening of the blast chamber. An input end of the nozzle is placed in fluid communication with the blast hose. The nozzle is disposed within the nozzle tube and the nozzle tube is pivotally connected to the housing with an attachment mechanism. Pivotal movement of the nozzle is regulated with respect to the surface to be treated by adjusting the attachment mechanism. Pressurized fluid is applied to the blast media and the blast media is transported to the nozzle via the blast hose. The blast media is applied from the nozzle through the second opening of the housing to the surface to be treated, thereby effecting desired blasting of the surface.

The standoff distance, the distance between the tip of the nozzle and the surface being treated, is preferably regulated by seating a bottom side of a housing on the surface to be treated, placing a nozzle tube in fluid communication with the first opening of the blast chamber, placing a first end of the nozzle holder in fluid communication with a blast hose, connecting a second end of the nozzle holder to the input end of the nozzle, disposing the nozzle holder in the nozzle tube, sliding the nozzle holder down the nozzle tube, and clamping the nozzle holder at one of a plurality of different predetermined positions, so as to facilitate control of an axial translation of the nozzle with respect to the surface to be treated, and applying pressurized fluid to the blast media.

The angle at which the blast media impacts the surface being treated is adjusted by regulating a pivotal movement of the nozzle tube with respect to the surface to be treated by adjusting the attachment mechanism.

Although the blast head of the present invention finds particular application in the removal of silicone adhesives from composite structures, those skilled in the art will appreciate that the present invention may be utilized in a wide variety of different applications. Thus, the blast head of the present invention may be utilized to remove a variety of different types of coatings, e.g., paints, lacquers, enamels, adhesives, etc., from a variety of different underlying surfaces. e.g., aluminum, steel, magnesium, titanium, polymer, composite, etc.

These, as well as other advantages of the present invention will become more apparent from the following description and drawings. It is understood that changes in the specific structure shown and described may be made within the scope of the claims without departing from the spirit of the invention.

DETAILED DESCRIPTION OF THE INVENTION

The detailed description set forth below in connection with the appended drawings is intended as a description of the presently preferred embodiment of the invention, and is not intended to represent the only form in which the present invention may be constructed or utilized. The description sets forth the functions and the sequence of the steps for constructing and operating the invention in connection with the illustrated embodiment. It is to be understood, however, that the same or equivalent functions may be accomplished by different embodiments that are also intended to be encompassed within the spirit and scope of the invention.

The blast head for abrasive blasting of the present invention is illustrated in FIGS. 1 through 7 which depict a presently preferred embodiment thereof.

Figure 1:
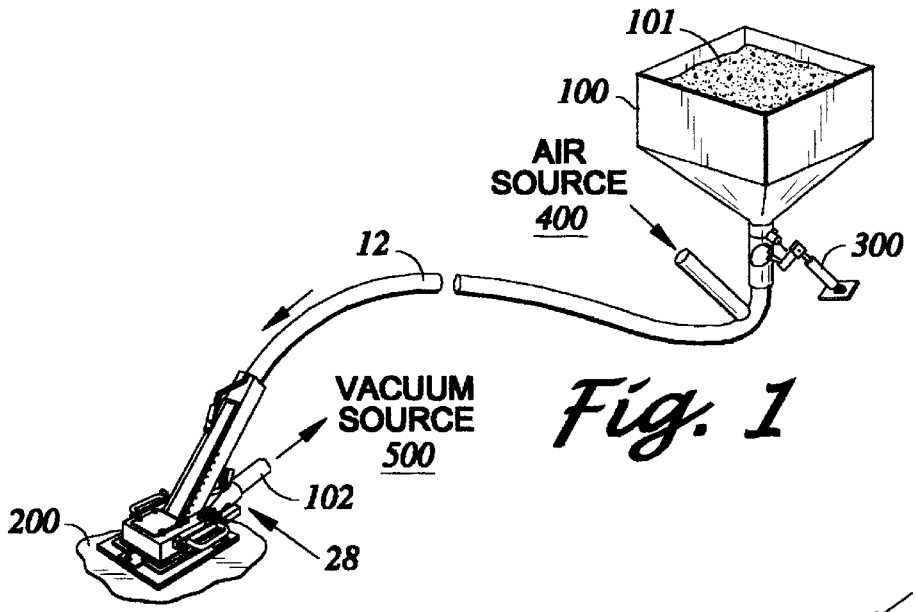
FIG. 1 shows an exemplary blasting system in accordance with the present invention.

Referring now to FIG. 1, the blast system is comprised generally of a media source 100 for providing blast media 101 to a blast head 200 via a blast hose 12, an actuator 300 for regulating the dispensation of the blast media 101 from the media source 100 into the blast hose 12, an air source 400 for providing pressurized air flow into the blast hose 12 to carry the dispensed blast media to the blast head 200, and a vacuum source 500 connected to the exhaust passage 28 of the blast head 200 by a vacuum duct 102 for providing a vacuum pressure to suck out a mixture of the dispensed blast media and particulate matter generated during blasting operation.

Figure 2:
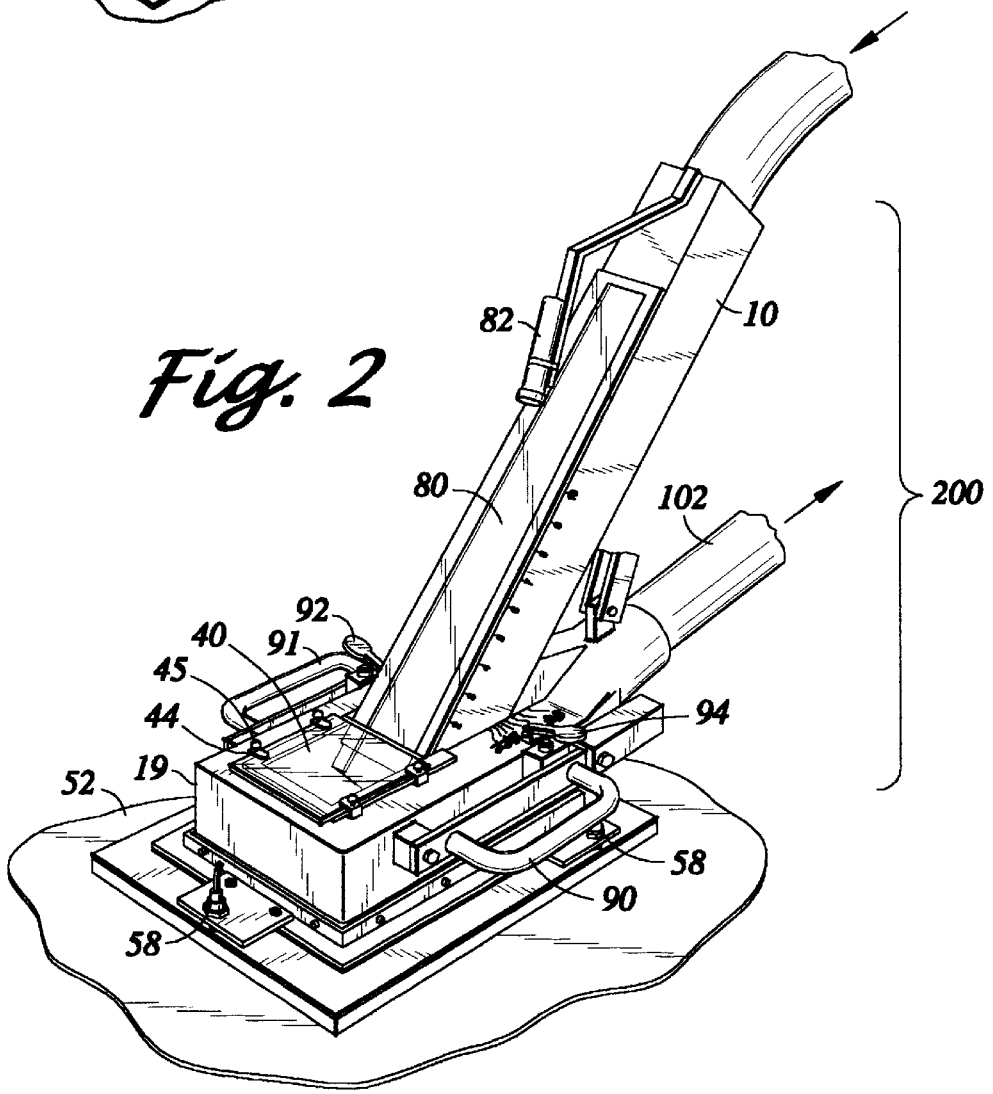
FIG. 2 is a perspective view of a blast head in a present embodiment of the invention.
Figure 3:
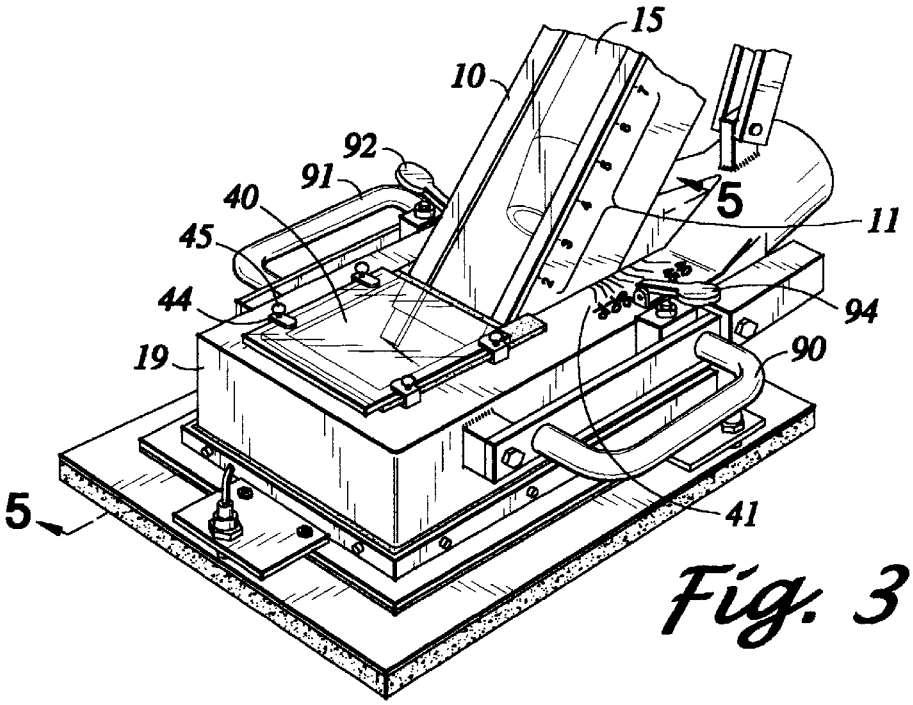
FIG. 3 is a close-up view of the housing of the blast head illustrated in FIG. 2.
Figure 4:
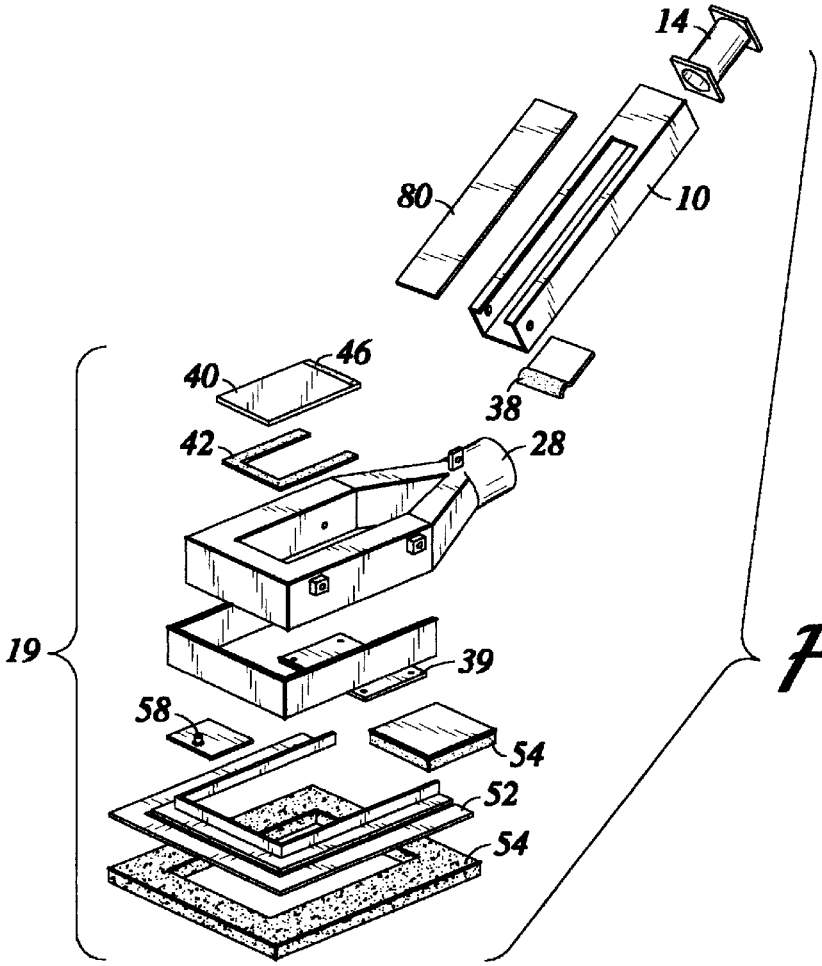
FIG. 4 is an exploded view of the housing, the nozzle tube and the nozzle holder of the blast head of FIG. 2.

Referring now to FIGS. 2–4, the blast head 200 includes a nozzle tube 10 inserted into a housing 19. The upper side of the nozzle tube 10 has a nozzle tube window 80 to provide visibility of the position of a nozzle 15 disposed inside the nozzle tube 10 for adjusting the standoff distance of the nozzle 15 with respect to the surface to be treated. Markings 11 for the stand-off distance are engraved on the nozzle tube 10. Markings 41 for the angle of the nozzle 15 axis relative to the surface to be treated are engraved on the housing 19.

In the present embodiment of the invention, window 80 is attached to the nozzle tube 10 with acrylic foam double back tape. The upper side of the housing 19 has a blast chamber window 40 to provide visibility of the blasting operation. Visibility is further aided by a rechargeable light 82 mounted on the nozzle tube 10 and directed towards both windows 40 and 80. Optionally, the light 82 is mounted on a flexible gooseneck mount to facilitate adjustment thereof. The blast chamber window 40 is attached to the housing 19 with clips 44 and wing screws 45. Blast chamber window 40 is easily removed for cleaning and/or replacement. Two handles 90 and 91 mounted on the sides of the housing 19 allow an operator to move the blast head 200 around during blasting operation.

Figure 6:
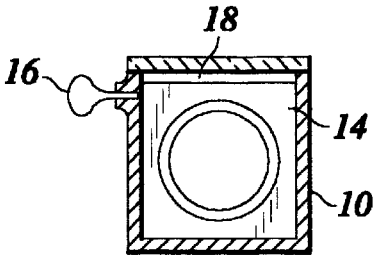
FIG. 6 is a cross-sectional view of the nozzle holder.
Figure 5:
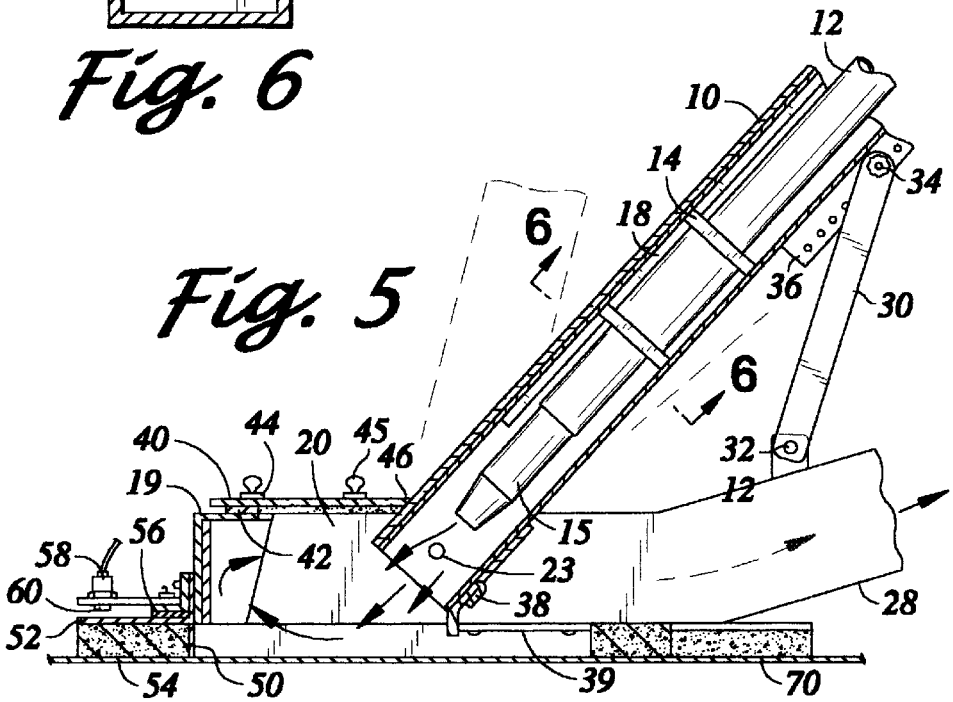
FIG. 5 is a longitudinal cross-sectional view of the blast head of FIG. 2.

Referring now to FIG. 5, a longitudinal cross-sectional view of the blast head 200 is provided. The blast head 200 includes the nozzle tube 10 of rectangular cross section and the housing 19. A nozzle holder 14, placed inside the nozzle tube 10, is attached at one end to the blast hose 12 and at the other end to the nozzle 15. A clamp bar 18 is affixed inside the nozzle tube 10. Referring to FIG. 5 and 6, the nozzle holder 14 slides down inside the nozzle tube 10, along clamp bar 18, to a desired location and is clamped at that position by thumb screws 16 tightened against clamp bar 18. Thumb screws 16 affixed to the structure of the nozzle tube 10.

The housing 19 includes a blast chamber 20 which has three openings. The nozzle tube 10 is inserted into the blast chamber 20 through the first opening. The second opening is exposed towards the surface 70 to be treated. The third opening forms the exhaust passage 28. The nozzle tube 10 is attached to the blast chamber 20 by a pivot mechanism 23 and by a support rod 30. The lower end of the support rod 30 is attached to the structure of the exhaust passage 28 of the blast chamber 20 by means of a pivot pin 32. The upper end of the support rod 30 is attached via a locking pin 34 to a calibrated bar 36 rigidly attached to the nozzle tube 10. Placement of the locking pin 34 at different holes of the calibrated bar 36 enables adjustment of the angle of the nozzle tube with respect to the surface 70.

The upper side of the blast chamber 20 includes a rectangular window 40 for enabling the operator to observe the blasting process. The window 40 is held in place by window clips 44 and its back side is sealed against the upper surface of the nozzle tube 10 by means of a rubber gasket 46. To maintain this seal and enable pivoting of the nozzle tube 10, the window 40 can be slid along window seal 42 by loosening the window screws 45 and clips 44. The bottom surface of the nozzle tube 10 is sealed with respect to the blast chamber 20 by a flexible attachment 38 which extends to contact the housing bottom piece 39.

Figure 7:
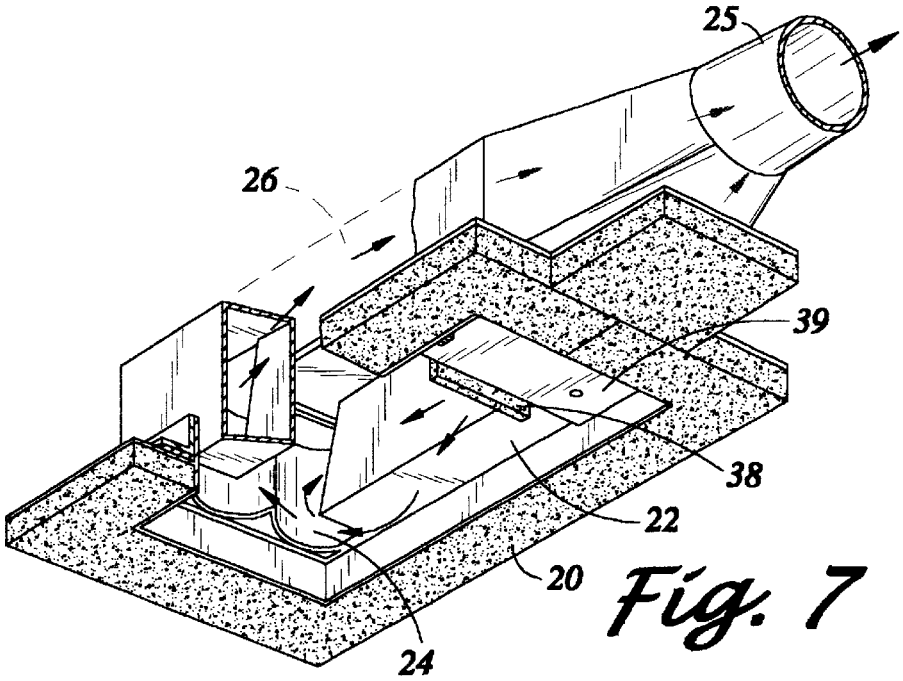
FIG. 7 is a perspective view of the housing of the blast head of FIG. 2, as seen from underneath, i.e., its bottom side.

Referring now to FIG. 7, the blast chamber 20, when sitting and sealed against the surface 70, forms a bifurcated air return 26 which guides the blast media 22 towards the back of the blast chamber where the bifurcation merges into the single exhaust passage 28. Referring to FIGS. 5 and 4, sealing of the blast chamber 20 against the surface 70 is accomplished by means of a rubber skirt 50, which is draped around the front and side surfaces of the blast chamber 20. Further sealing is achieved by use of woven plastic pads 54 attached to wings 52 mounted on the housing 19.

Referring to FIGS. 5 and 2, the wings 52 are mounted flexibly on the housing 19 by means of rubber pads 56. Thus, when the blast head sits on the surface 70, the wings 52 deflect upward due to the weight of the device. This upward deflection of the wings 52 depresses the buttons 60 of three interlock valves 58 rigidly affixed to the housing 19. The action of the interlock valves 58 enables operation of the blast head 200 only when it is seated against a plane surface.

Referring back to FIGS. 2 and 3, a manually operated override valve switch 92, placed in the vicinity of the handle 91, is used to bypass the action of the aforementioned interlock valves 58 and thus permits operation of the blast head 200 on curved surfaces or when it is not in contact with any surface. Fingertip switch 94 located on the right hand side of the housing 19 is connected to a "deadman" control valve, permitting operation of the blast head 200 only when the fingertip switch 94 is depressed.

It is understood that the exemplary blasting system described herein and shown in the drawings represents only a presently preferred embodiment of the invention. Indeed, various modifications and additions may be made to such embodiment without departing from the spirit and scope of the invention. For example, the blast head needs not be configured as illustrated. Also, although the blast head is designed to operate with wheat starch as blast media, it will support blasting of other light dry media such as plastic. Although the blast head will work with the conventional media such as aluminum oxide, glass beads, etc., the use of these media will impose severe wear factor on the device unless suitable wear-resistant materials are used to construct the blast head. Those skilled in the art will recognize that various other configurations are equivalent and therefore likewise suitable. Thus, these and other modifications and additions may be obvious to those skilled in the art and may be implemented to adapt the present invention for use in a variety of different applications.

What is claimed is:

1. A blast head for abrasive blasting, wherein blast media impact a surface to be treated at a regulatable angle and at a regulatable stand-off distance, the blast head comprising:

(a) a housing, having a bottom side configured to be seated on the surface to be treated, the housing including a blast chamber therein having a first opening for receiving blast media and a second opening exposed toward the surface to be treated;

(b) a nozzle tube in fluid communication with the first opening of the blast chamber, the nozzle tube having a nozzle tube longitudinal axis;

(c) a nozzle disposed in the nozzle tube, for applying the blast media to the surface to be treated through the second opening of the blast chamber;

(d) an attachment mechanism, disposed on the housing, pivotally connecting the nozzle tube to the housing about a pivot axis orthogonal to the nozzle tube longitudinal axis, thereby facilitating control of a pivotal movement of the nozzle with respect to the surface to be treated; and (e) a nozzle holder, disposed in the nozzle tube, the nozzle holder being formed to engage the nozzle tube with respect to one of a plurality of different predetermined positions along the nozzle tube longitudinal axis so as to facilitate control of an axial translation of the nozzle with respect to the surface to be treated.

2. The blast head for abrasive blasting as recited in claim 1 further comprising a sealing assembly, disposed about a periphery of the bottom side of the housing and configured to contact the surface to be treated, for blocking blast media and particulate matter generated during blasting operation in the blast chamber from communicating with an ambient environment, said sealing assembly being configured to allow a controlled intake of ambient air into the blast chamber so as to prevent the blast head from being drawn by suction force to the surface to be treated during blasting operation and so as to facilitate operation.

3. The blast head for abrasive blasting as recited in claim 2 wherein the sealing assembly comprises a strip draping a substantial portion of a periphery of the second opening of the housing, said strip making contact with the surface to be treated so as to form a seal.

4. The blast head for abrasive blasting as recited in claim 3 wherein the strip is made of elastomeric material.

5. The blast head for abrasive blasting as recited in claim 1 further comprising a flexible porous pad in contact with the periphery of the surface to be treated, for forming a weight-bearing surface and for blocking blast media and particulate matter generated during blasting operation in the blast chamber from communicating with an ambient environment while allowing a controlled intake of ambient air into the blast chamber.

6. The blast head for abrasive blasting as recited in claim 5 wherein the flexible porous pad is made of woven polymeric material.

7. The blast head for abrasive blasting as recited in claim 1 wherein the pivotal movement of the nozzle with respect to the surface to be treated is regulatable from about 15 degrees to about 75 degrees.

8. The blast head for abrasive blasting as recited in claim 1 wherein the housing further comprises a window configured to provide visibility of the second opening to facilitate observation of blasting operation.

9. The blast head for abrasive blasting as recited in claim 1 wherein the nozzle tube further comprises a window for providing visibility of the nozzle to facilitate control of the axial translation of an nozzle with respect to the surface to be treated.

10. The blast head for abrasive blasting as recited in claim 1 wherein the blast chamber further comprising a third opening forming an exhaust passage, the blast chamber being configured to form a bifurcated air return, said bifurcated air return guiding blast media and particulate matter generated during blasting operation toward the exhaust passage, said bifurcated air return merging into the exhaust passage.

11. The blast head for abrasive blasting as recited in claim 1 wherein the nozzle is of a venturi type, having transverse openings located in proximity of an output end of the nozzle to draw air into an internal flow stream of blast media, thereby increasing dispersion of blast media in pressurized fluid and decreasing the velocity of the pressurized blast media as said pressurized blast media enter the blast chamber.

12. A blast head for abrasive blasting, wherein blast media impact a surface to be treated at a regulatable angle and at a regulatable stand-off distance, the blast head comprising:

(a) a housing, having a bottom side configured to be seated on the surface to be treated, the housing including a blast chamber therein having a first opening for receiving blast media, a second opening exposed toward the surface to be treated, and a third opening forming an exhaust passage;

(b) a nozzle tube in fluid communication with the first opening of the blast chamber;

(c) a nozzle disposed in the nozzle tube, for applying the blast media to the surface to be treated through the second opening of the blast chamber;

(d) an attachment mechanism, disposed on the housing, pivotally connecting the nozzle tube to the housing, thereby facilitating control of a pivotal movement of the nozzle with respect to the surface to be treated; and (e) a nozzle holder, disposed in the nozzle tube, having a first end in fluid communication with a blast hose, and a second end connected to the input end of the nozzle, the nozzle holder being slid down the nozzle tube and clamped at one of a plurality of different predetermined positions so as to facilitate control of an axial translation of the nozzle with respect to the surface to be treated; and (f) a flexible porous pad formed of a woven polymeric material draping a substantial portion of a periphery of the second opening of the housing, the pad being formed to contact a periphery of the surface to be treated, for forming a weight-bearing surface and for blocking blast media and particulate matter generated during blasting operation in the blast chamber from communicating with an ambient environment while allowing a controlled intake of ambient air into the blast chamber.

13. A blast head for abrasive blasting, wherein blast media impact a surface to be treated at a regulatable angle and at a regulatable stand-off distance, the blast head comprising:

(a) a housing, having a bottom side configured to be seated on the surface to be treated, the housing including a blast chamber therein having a first opening for receiving blast media, a second opening exposed toward the surface to be treated, and a third opening forming an exhaust passage;

(b) a nozzle tube in fluid communication with the first opening of the blast chamber;

(c) a nozzle disposed in the nozzle tube, for applying the blast media to the surface to be treated through the second opening of the blast chamber;

(d) an attachment mechanism, disposed on the housing, pivotally connecting the nozzle tube to the housing, thereby facilitating regulation of a pivotal movement of the nozzle with respect to the surface to be treated from about 15 degrees to about 75 degrees; and (e) a nozzle holder, disposed in the nozzle tube, having a first end in fluid communication with a blast hose, and a second end connected to the input end of the nozzle, the nozzle holder being slid down the nozzle tube and clamped at one of a plurality of different predetermined positions so as to facilitate control of an axial translation of the nozzle with respect to the surface to be treated.

14. A blast head for abrasive blasting, wherein blast media impact a surface to be treated at a regulatable angle and at a regulatable stand-off distance, the blast head comprising:

(a) a housing, having a bottom side configured to be seated on the surface to be treated, the housing including a blast chamber therein having a first opening for receiving blast media, a second opening exposed toward the surface to be treated, and a third opening forming an exhaust passage, the blast chamber being configured to form a bifurcated air return, the bifurcated air return guiding blast media and particulate matter generated during blasting operation toward the exhaust passage, said bifurcated air return merging into the exhaust passage;

(b) a nozzle tube in fluid communication with the first opening of the blast chamber;

(c) a nozzle disposed in the nozzle tube, for applying the blast media to the surface to be treated through the second opening of the blast chamber;

(d) an attachment mechanism, disposed on the housing, pivotally connecting the nozzle tube to the housing, thereby facilitating control of a pivotal movement of the nozzle with respect to the surface to be treated; and (e) a nozzle holder, disposed in the nozzle tube, having a first end in fluid communication with a blast hose, and a second end connected to the input end of the nozzle, the nozzle holder being slid down the nozzle tube and clamped at one of a plurality of different predetermined positions so as to facilitate control of an axial translation of the nozzle with respect to the surface to be treated.

15. A blast head for abrasive blasting, wherein blast media impact a surface to be treated at a regulatable angle and at a regulatable stand-off distance, the blast head comprising:

(a) a housing, having a bottom side configured to be seated on the surface to be treated, the housing including a blast chamber therein having a first opening for receiving blast media and a second opening exposed toward the surface to be treated;

(b) a nozzle tube in fluid communication with the first opening of the blast chamber, the nozzle tube having a nozzle tube longitudinal axis, the nozzle tube being connected to the housing about a pivot axis orthogonal to the nozzle tube longitudinal axis, thereby facilitating control of a pivotal movement of the nozzle with respect to the surface to be treated; and (c) a nozzle disposed in the nozzle tube for applying the blast media to the surface to be treated through the second opening of the blast chamber, the nozzle being formed to engage the nozzle tube with respect to one of a plurality of different predetermined positions along the nozzle tube longitudinal axis so as to facilitate control of an axial translation of the nozzle with respect to the surface to be treated.

16. The blast head of claim 15 wherein the nozzle holder has a first end in fluid communication with a blast hose, and a second end connected to the input end of the nozzle, the nozzle holder being slid down the nozzle tube and clamped at one of a plurality of different predetermined positions so as to facilitate control of an axial translation of the nozzle with respect to the surface to be treated.

17. An abrasive blast system, wherein blast media impact a surface to be treated at a regulatable angle and at a regulatable stand-off distance, the system comprising:

(a) a blast head comprising:

a housing, having a bottom side configured to be seated on the surface to be treated, the housing including a blast chamber therein having a first opening for receiving blast media, a second opening exposed toward the surface to be treated, and a third opening forming an exhaust passage;

a nozzle tube in fluid communication with the first opening of the blast chamber;

a nozzle, disposed in the nozzle tube, having an input end and an output end, for applying the blast media to the surface to be treated through the second opening of the blast chamber;

an attachment mechanism, disposed on the housing, pivotally connecting the nozzle tube to the housing, thereby facilitating control of a pivotal movement of the nozzle with respect to the surface to be treated; and a nozzle holder, disposed in the nozzle tube, having a first end in fluid communication with a blast hose, and a second end connected to the input end of the nozzle, the nozzle holder being slid down the nozzle tube and clamped at one of a plurality of different predetermined positions so as to facilitate control of an axial translation of the nozzle with respect to the surface to be treated;

(b) a blast media source for providing blast media, said blast media source being connectable to the blast hose;

(c) an actuator, regulating dispensing of the blast media from the media source into the blast hose;

(d) a fluid source, connected to the blast hose downstream from the actuator, for providing a pressurized fluid flow into the blast hose, said pressurized fluid flow carrying the dispensed blast media to the blast head;

(e) a vacuum source for providing reduced pressure, said vacuum source being connected to the exhaust passage of the bast chamber by a vacuum duct, said reduced pressure sucking out a mixture of the dispensed blast media and particulate matter generated during blasting operation; and (f) a system of interlock valves for enabling operation of the blast head, the blast head being seated against a plane surface.

18. The abrasive blast system as recited in claim 17 wherein the fluid source comprises an air source.

19. The abrasive blast system as recited in claim 17 wherein the blast media source comprises a source of wheat starch of mesh size of about sixty.

20. The abrasive blast system as recited in claim 17 wherein the blast head further comprises an override valve mechanism for enabling operation of the blast head when the blast head not being seated against a plane surface.

21. A method for abrasive blasting, wherein an angle and a stand-off distance at which blast media impact a surface to be treated are regulated, the method comprising the steps of:

(a) seating a bottom side of a housing on the surface to be treated, the housing including a blast chamber therein having a first opening for receiving pressurized blast media, and a second opening exposed toward the surface to be treated;

(b) placing a nozzle tube in fluid communication with the first opening of the blast chamber, the nozzle tube having a nozzle tube longitudinal axis;

(c) pivotally connecting the nozzle tube to the housing about a pivot axis orthogonal to the nozzle tube longitudinal axis with an attachment mechanism;

(d) regulating a pivotal movement of the nozzle tube with respect to the surface to be treated by adjusting the attachment mechanism;

(e) placing a first end of a nozzle holder in fluid communication with a blast hose;

(f) connecting a second end of the nozzle holder to an input end of a nozzle;

(g) disposing the nozzle holder in the nozzle tube;

(h) sliding the nozzle holder down the nozzle tube;

(i) engaging the nozzle at one of a plurality of different predetermined positions along the nozzle tube longitudinal axis, so as facilitate control of an axial translation of the nozzle with respect to the surface to be treated;

(j) applying pressurized fluid to blast media;

(k) transporting the blast media to the nozzle via the blast hose; and (l) applying the blast media from the nozzle through the second opening to the surface to be treated.

* * * * *